US006265123B1

(12) United States Patent
Kakui et al.

(10) Patent No.: US 6,265,123 B1
(45) Date of Patent: Jul. 24, 2001

(54) ELECTROPHOTOGRAPHIC PHOTOSENSITIVE ELEMENT AND MANUFACTURING METHOD THEREOF

(75) Inventors: Mikio Kakui, Ikoma-gun; Tatsuhiro Morita, Kashiba; Rikiya Matsuo, Nara; Sayaka Fujita, Kashihara; Kazushige Morita, Ikoma-gun; Yoshihide Shimoda, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/533,071

(22) Filed: Mar. 22, 2000

(30) Foreign Application Priority Data

Apr. 12, 1999 (JP) ..... 11-104074

(51) Int. Cl.[7] ..... G03G 5/06
(52) U.S. Cl. ..... 430/58.2; 430/59.4; 430/129
(58) Field of Search ..... 430/58.2, 59.2, 430/59.4, 129

(56) References Cited

U.S. PATENT DOCUMENTS 4,150,987 4/1979 Anderson et al. ..... 430/1.5
5,821,021 * 10/1998 Kawahara ..... 430/56
6,136,483 * 10/2000 Suzuki et al. ..... 430/58.7

FOREIGN PATENT DOCUMENTS 50-10496 4/1975 (JP) .
62-150255 7/1987 (JP) .
62-226156 10/1987 (JP) .
3-65961 3/1991 (JP) .
7-128890 5/1995 (JP) .
8-278649 10/1996 (JP) .

* cited by examiner

*Primary Examiner*—John Goodrow
(74) *Attorney, Agent, or Firm*—Nixon & Vanderhye P.C.

(57) ABSTRACT

An electrophotographic photosensitive element is provided with a photosensitive layer containing a charge generating substance and a charge transport substance on a conductive support. X-type metal-free phthalocyanine and a disazo compound are contained as a charge generating substance. With the photosensitive element, sufficient sensitivity is achieved so as to cause virtually no problem, and it is possible to reduce possibility of causing an instable electrostatic property such as a reduction in a charge potential and an increase in a remained potential, even in the case of frequent reuse.

14 Claims, 1 Drawing Sheet

ELECTROPHOTOGRAPHIC PHOTOSENSITIVE ELEMENT AND MANUFACTURING METHOD THEREOF

FIELD OF THE INVENTION

The present invention relates to an electrophotographic photosensitive element used for an electrophotographic output apparatus such as a copying machine and a laser printer, and a manufacturing method thereof.

BACKGROUND OF THE INVENTION

Conventionally, as a photoconductive material (charge generating substance and charge transport substance), an inorganic material selected from Se, CdS, and Zn has been adopted. However, these inorganic materials have problems in photosensitivity (particularly, photosensitivity in a long wavelength area), thermo-stability, toxicity, and others. Therefore, in recent years, an electrophotographic photosensitive element using an organic material as a photoconductive material (charge generating substance and/or charge transport substance) has been earnestly developed because the organic meterial achieves an excellent film-forming property, the absence of the above problems, and a wide range of choices of materials.

The electrophotographic photosensitive elements using an organic material as a photoconductive material include a) a single-layer electrophotographic photosensitive element, in which a charge transport substance and a charge generating substance made of organic materials are dispersed into a binder resin (binding agent), and b) a laminated (divided by function) electrophotographic photosensitive element, in which a charge generating layer containing a charge generating substance made of an organic material and a charge transporting layer containing a charge transport substance are stacked on a conductive support.

An example of the above single-layer electrophotographic photosensitive element is disclosed in Japanese Published Examined Patent No. 10496/1975 (Tokukosho 50-10496, published in 1975) and Japanese Unexamined Patent Publication No. 65961/1991 (Tokukaihei 3-65961), in which a pigment such as a perylene pigment and a phthalocyanine pigment is used as a charge generating substance.

The single-layer electrophotographic photosensitive element can be readily manufactured at low cost with a operational process causing few toxic matters (ozone). Most of the single-layer electrophotographic photosensitive elements are positively charged because of restrictions on a material property.

Further, the laminated electrophotographic photosensitive element has a simple formulated arrangement, high sensitivity, and high stability so as to be widely adopted as an electrophotographic photosensitive element using organic materials as photoconductive materials. Such a laminated electrophotographic photosensitive element is disclosed in, for example, Japanese Published Examined Patent No. 42380/1980 (Tokukosho 55-42380, published in 1980), in which a charge generating layer containing a specified organic compound and a charge transport substance are combined with each other.

Meanwhile, in order to respond to the increasing needs for digitalization and networking, the number of electrophotographic output apparatuses such as a laser beam printer and a digital copying machine has been rapidly increasing. Such an electrophotographic output apparatus has a semiconductor laser, an LED (Light Emitting Diode), and the like as a digital light source.

It is not possible to adopt a conventional analog photosensitive element for the above electrophotographic output apparatus using a digital light source. This is because the conventional analog photosensitive element has its sensitivity in a visible ray area and most of the elements have peak wavelengths at around 550 nm, so that the sensitivity becomes lower when using a digital light source of the semiconductor laser and the like (generally, its peak wavelength is around 670 nm and 780 nm). Namely, in order to develop a photosensitive element for the electrophotographic output apparatus using a digital light source, it is necessary to adopt a charge generating substance being capable of favorably absorbing light in a near-infrared region regardless of whether it is single-layer or laminated one.

Typical photoconductive charge generating pigments, that exert high sensitivity to light of the near-infrared region, include a metal-containing phthalocyanine pigment such as titanylphthalocyanine, vanadylphthalocyanine, aluminum chlorophthalocyanine, indiumchlorophthalocyanine, galliumhydroxyphthalocyanine, and galliumchlorophthalocyanine; a metal-free phthalocyanine pigment having no metallic atom at the center; and other pigments. Furthermore, although a pigment such as a pyrroles pigment and trisazos pigment is a relatively peculiar material, they can be adopted as photoconductive charge generating pigment.

According to a report, the above-mentioned organic pigments respectively have several to several tens types of specific crystals, and each crystal type has a different degree of sensitivity to light. For example, the metal-containing phthalocyanine pigment such as titanylphthalocyanine shows higher sensitivity for a specific crystal type as compared with the metal-free phthalocyanine pigment. However, the metal-containing phthalocyanine pigment of this type is manufactured in a complicated process because of the need for an industrially complicated operation for conversing crystals, resulting in a large increase in the manufacturing cost.

Moreover, a pigment such as a pyrroles pigment and trisazos pigment is so special that such an material is more expensive than the typical metal-free phthalocyanine pigment and the disazo pigment that has been widely used for an analog photosensitive element.

For this reason, a large number of electrophotographic sensitive elements using the metal-free phthalocyanine pigment, which is relatively inexpensive as a charge generating substance (see Japanese Unexamined Patent Publication No. 150255/1987 (Tokukaisho 62-150255, published on Jul. 4, 1987), Japanese Unexamined Patent Publication No. 226156/1987 (Tokukaisho 62-226156, published on Oct. 5, 1987), Japanese Unexamined Patent Publication No. 128890/1995 (Tokukaihei 7-128890, published on May 19, 1995), and Japanese Unexamined Patent Publication No. 278649/1996 (Tokukaihei 8-278649, published on Oct. 22, 1996)).

However, with the electrophotographic photosensitive element using the metal-free phthalocyanine pigment, the material cost can be reduced; however, it is difficult to sufficiently obtain a property (property for an actual use of electrophotography) of the photosensitive element.

To be specific, for instance, the electrophotographic photosensitive element has less stable sensitivity. Further, when the sensitivity is repeatedly used, problems such as reduction in charge potential and an increase in remained potential cause an unstable electrostatic property. As a result, in the electrophotographic output apparatus, a defect of image concentration and an increased fog density, so that it is difficult to achieve high reliability. The above-mentioned problems occur in the laminated photosensitive element being more superior than single-layer one in its property as well as in the single-layer photosensitive element using the metal-free phthalocyanine pigment as a charge product.

SUMMARY OF THE INVENTION

The present invention is devised to solve the above-mentioned problems. The objective is to provide an electrophotographic photosensitive element, in which X-type metal-free phthalocyanine known as an inexpensive material with high versatility is used as a charge generating product, has sensitivity enough to virtually prevent a problem and prevents an unstable electrostatic property such as reduction in a charge potential and an increase in a remained potential, and to provide a manufacturing method thereof.

The inventor et al. has earnestly devised the electrophotographic photosensitive element and the manufacturing method thereof.

Consequently, the inventor et al. completed the present invention as follows: a photosensitive layer is allowed to contain (a) X-type metal-free phthalocyanine (X-type metal-free phthalocyanine pigment) showing high sensitivity in a near-infrared region as a charge generating material and (b) a specific disazo compound (bisazo compound) having high sensitivity in a visible ray region, so that it is possible to provide an electrophotographic photosensitive element that can achieve the following effects: 1) the effect of increasing sensitivity to more than the total sensitivity of the disazo compound and the X-type metal-free phthalocyanine, that have the above constructions and are separately used, and 2) a charge potential is not reduced and a remained potential is not increased even in the case of frequent reuse, namely, the electrostatic property is stable.

Namely, in order to achieve the above objective, the electrophotographic photosensitive element of the present invention is provided with the photosensitive layer containing a charge generating substance and a charge transporting substance on a conductive support, and X-type metal-free phthalocyanine and a disazo compound are contained as the charge generating substances, the disazo compound being represented by the following general formula (1).

(1)

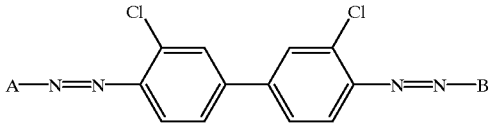

(Here, in the general formula (1), A and B respectively correspond to any one of coupler remained groups represented by the following general formulas (2)–(7), and A and B can also serve as coupler remained groups having the same construction.)

(2)

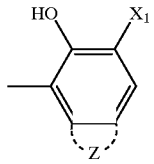

(3)

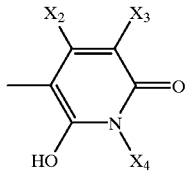

(4)

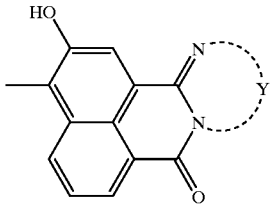

(5)

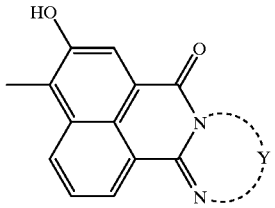

(6)

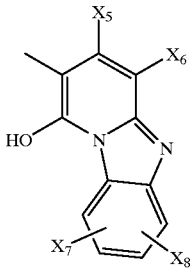

(7)

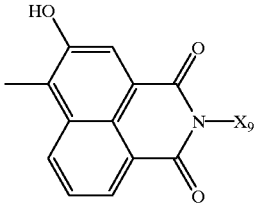

(In the above general formulas (2)–(7), $X_1$ represents a hydrogen atom or CONHR (R represents a hydrogen atom, an alkyl group, which is allowed to have a substituent, an aryl group, or a heterocyclic group); Z represents a remained group which is condensed with a benzene ring so as to form an aromatic ring or an aromatic heterocycle; $X_2$ and $X_5$ independently represent an alkyl group, which is allowed to have a substituent, an aryl group, or a heterocyclic group; $X_3$ and $X_6$ independently represent a hydrogen atom, a cyano group, a carbamoyl group, a carboxyl group, ester group, or an acyl group; $X_4$ and $X_9$ independently represent a hydrogen atom, an alkyl group, which is allowed to have a substituent, a cycloalkyl group, an alkenyl group, an aralkyl group, an aryl group, or a heterocyclic group; $X_7$ and $X_8$ independently represent a hydrogen atom, a halogen group, a nitro group, an alkyl group, which is allowed to have a substituent, and an alkoxy group; and Y represents a remained group forming an aromatic hetrocycle.)

In the electrophotographic photosensitive element, each of the X-type metal-free phthalocyanine and the disazo compound preferably has a particle median diameter of 1.0 μm or less.

In the electrophotographic photosensitive element, the photosensitive layer has a charge generating layer containing a charge generating substance and a charge transport layer containing a charge transport substance. In the charge generating layer, the amount of the disazo compound relative to the X-type metal-free phthalocyanine is preferable between 10 and 70 parts by weight relative to 100 parts by weight of the X-type metal-free phthalocyanine.

It is desirable that the electrophotographic photosensitive element further include a binding agent for binding the charge generating substance and the binding agent be vinyl chloride-vinyl acetate copolymers resin.

According to the above arrangement, it is possible to provide the electrophotographic photosensitive element that can achieve the following effects: 1) the effect of increasing sensitivity to more than the total sensitivity of the disazo compound and the X-type metal-free phthalocyanine, that have the above constructions and are separately used, and 2) a charge potential is not reduced and a remained potential is not increased even in the case of frequent reuse, namely, the electrostatic property is stable.

Moreover, according to the above arrangement, the photosensitive element has a construction in which the two kinds of the charge generating substances are co-dispersed into the binding agent (particularly, vinyl chloride-vinyl acetate copolymer resin), so that it is possible to provide the electrophotographic photosensitive element having a more favorable property.

Therefore, with the electrophotographic photosensitive element of the present invention, it is possible to realize an electrophotographic output apparatus, which has excellent sensitivity so as to reduce uneven sensitivity from a visible ray to light in a near-infrared region, and which prevents reduction in an image concentration and the increased fog density even in the case of frequent reuse.

Furthermore, in order to solve aforementioned problems, a manufacturing method for the electrophotographic photosensitive element of the present invention, which is devised as a manufacturing method for any one of the above-mentioned electrophotographic photosensitive elements, includes the step of grinding the disazo compound under coexistence with the X-type metal-free phthalocyanine.

Additionally, the manufacturing method for the electrophotographic photosensitive element further includes the step of preparing a coating for the charge generating layer or the photosensitive layer that contains the X-type metal-free phthalocyanine and the disazo compound. It is desirable to adopt a solvent which contains at least one of materials selected from methyl ethyl ketone, cyclohexanone, and tetrahydrofran.

According to the above method, it is possible to more povitively provide the electrophotographic photosensitive element which can achieve the following effects: 1) the sensitivity is increased to more than the total sensitivity of the disazo compound and the X-type metal-free phthalocyanine, that have the aforementioned constructions and are separately used, and 2) a charge potential is not reduced and a remained potential is not increased even in the case of frequent reuse, namely, the electrostatic property is stable.

Hence, with the electrophotographic photosensitive element manufactured by the manufacturing method of the present invention, it is possible to achieve the electrophotographic output apparatus, which has excellent sensitivity so as to reduce uneven sensitivity from a visible ray to light in a near-infrared region, and which prevents reduction in an image concentration and the increased fog density even in the case of frequent reuse.

For a fuller understanding of the nature and advantages of the invention, reference should be made to the ensuing detailed description taken in conjunction with the accompanying drawings.

DESCRIPTION OF THE EMBODIMENTS

Figure 1:
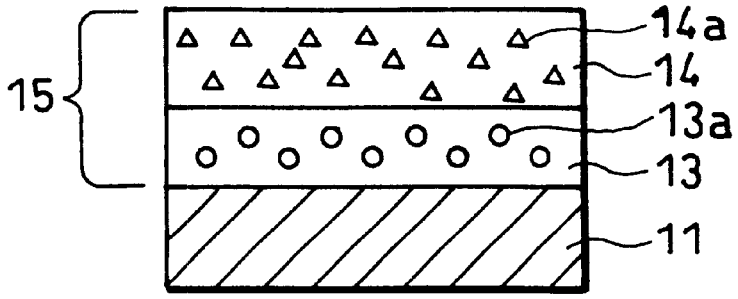
FIG. 1 is a sectional view schematically showing a laminated electrophotographic photosensitive element in accordance with one example of the present invention.

The following explanation describes an electrophotographic photosensitive element (hereinafter, simply referred to as a photosensitive element) in accordance with one embodiment of the present invention. The photosensitive element has a photosensitive layer (photoconductive layer) containing a charge generating substance and a charge transport substance, on a conductive support. An X-type metal-free phthalocyanine (X-type metal-free phthalocyanine pigment) and a disazo compound (disazo pigment) having a specific structure are contained as the charge generating substances.

The conductive support acts as an electrode of the photosensitive element and also acts as a support of other layers (to be specific, a layer such as a photosensitive layer and an intermediate layer that is stacked on the conductive support). The form of the conductive support is not particularly limited. To be specific, it is possible to adopt a form such as a cylinder, a plate, a film, and a belt. Further, the material is not particularly limited as long as it has conductivity. For example, it is possible to adopt a metal selected from aluminum, stainless steel, and nickel; and glass and resin on which a conducting operation is performed.

The conductivity of the conductive support is not particularly limited. However, it is more preferable to set a volume resistance at $10^{10}$ Ωcm or less. Some materials forming the conductive support can be subjected to an oxidizing operation to adjust a volume resistance at a suitable value.

The above photosensitive layer contains a disazo compound, an X-type metal-free phthalocyanine (charge generating substance), and a charge transport substance, that have the following specific structures.

The photosensitive layer includes a) a single-layer photosensitive layer, in which a charge generating substance and a charge transport substance are dispersed, and b) a laminated layer consisting of a charge generating layer, in which a charge generating substance is dispersed, and a charged transport layer, in which a charge transport substance is dispersed.

As examples of the charge transport substance, it is possible to adopt an electronic transport material (material for electronic transport) and a positive hole transport material. As the electronic transport material, it is possible to adopt a material selected from 2,4,7-trinitro-9-fluorenone, 2,4,5,7-tetranitro-9-fluorenone, 2,4,5,7-tetranitroxanthone, a diphenoquinone derivative, a benzoquinone derivative, and others. However, the transport material is not particularly limited to these.

Further, as the positive hole material, it is possible to adopt a material selected from a hydrazone derivative, a pyrene derivative, a pyrene-formaldehyde condensate and its derivative, an oxazole derivative, an oxaziazole derivative, an imidazole derivative, a monoarylamine derivative, a diarylamine derivative, a stilbene derivative, an enamine derivative, an α-phenylstilbene derivative, a benzidine derivative, a diarylmethane derivative, a triarylmethane derivative, an anthracene derivative, a pyrazolyne derivative, an indene derivative, a butadiene derivative, a polysilane compound, and a polygermane compound. However, the positive hole transport material is not particularly limited to these. More than one of these charge transport substances can be adopted if necessary.

The X-type metal-free phthalocyanine serving as the charge generating substance is manufactured by, for example, milling α-type metal-free phthalocyanine. The kind of the X-type metal-free phthalocyanine is not particularly limited, so that a conventional one can be used. The X-type metal-free phthalocyanine has a high sensitivity in a near-infrared region. A single kind of the X-type metal-free phthalocyanine can be used, or more than one kind of the X-type metal-free phthalocyanine can be also used in a simultaneous manner.

The disazo compound serving as the charge generating substance is not particularly limited as long as it has the structure shown in the general formula (1). A single kind of the disazo compound can be used, or more than one kind of the disazo compound can be used simultaneously.

To be specific, the disazo compounds represented by the following chemical constitutional formulas (8)–(11), (21), and (22) can be adopted. However, the disazo compound is not particularly limited to these.

(8)

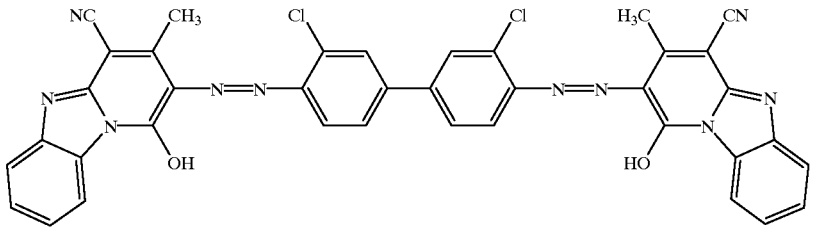

(9)

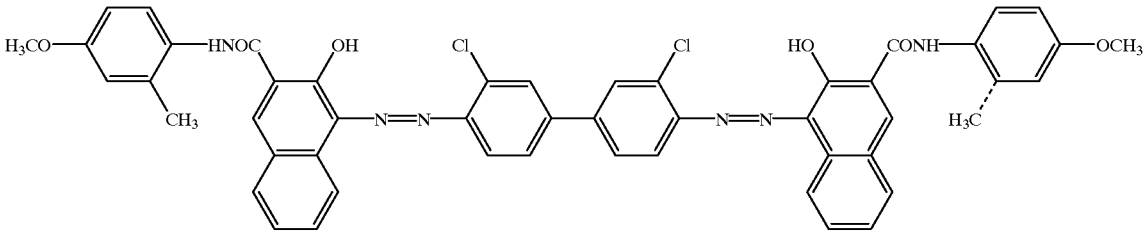

(10)

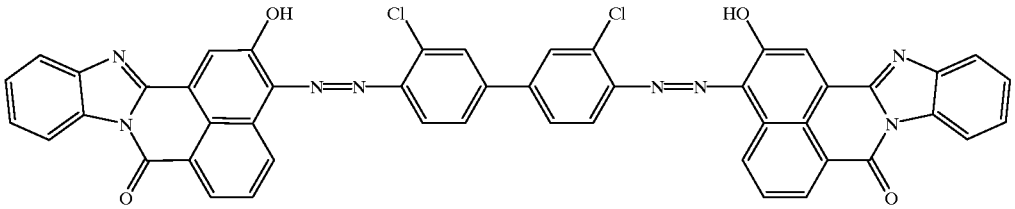

(11)

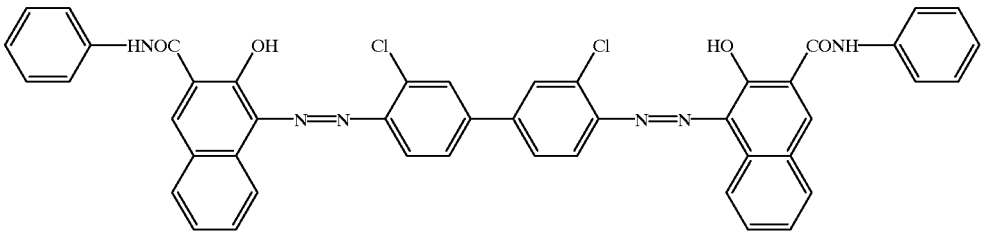

-continued (21)

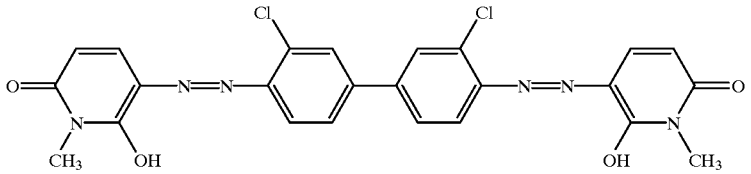

(22)

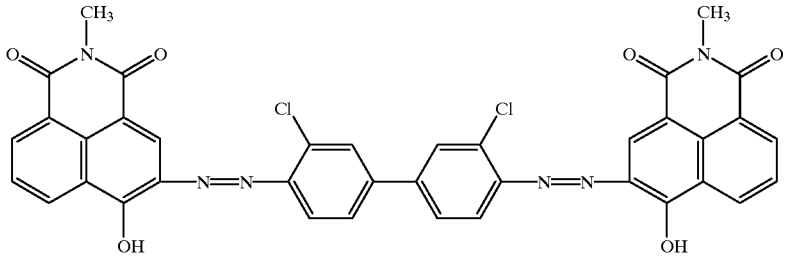

Additionally, in the following Examples, the disazo compounds represented by the chemical constitutional formulas (8)–(11) are referred to as disazo compounds (1)–(4).

The manufacturing method of the disazo compound is not particularly limited. For example, the disazo compound can be manufactured by reacting a corresponding diazonium salt compound and couplers corresponding to A and B in two steps. Here, when A and B have the same structure, the reaction can be done in one step. Moreover, the disazo compound generally has high sensitivity in a visible ray region.

As described above, the photosensitive element of the present invention has a construction in which the photosensitive layer contains the X-type metal-free phthalocyanine (X-type metal-free phthalocyanine pigment) having high sensitivity in a near-infrared region, and the specific disazo compound (disazo pigment) having high sensitivity in a visible ray region.

For example, this construction can achieve the following effects: 1) the sensitivity is increased to more than the total sensitivity of the disazo compound and the X-type metal-free phthalocyanine, that have the above constructions and are separately used, and 2) a charge potential is not reduced and a remained potential is not increased even in the case of frequent reuse, namely, the electrostatic property is stable.

Therefore, with the photosensitive element of the present invention, it is possible to realize an electrophotographic output apparatus (for example, a copying machine, kinds of printers, and others) that can exert a superior sensitivity without causing uneven sensitivity of light in a visible ray region and a near-infrared region, and that does not cause the increased fog density or reduce image concentration even in the case of frequent reuse. The reason why a favorable photosensitive property is achieved is not clear. However, probably this is because the disazo compound and the X-type metal-free phthalocyanine can be preferably matched to each other regarding an energy level.

Further, when the photosensitive element has the two kinds of the charge generating substances being co-dispersed in the following binding agent (binding agent for the charge generating layer, and a binding agent for the photosensitive layer), it is possible to obtain a more preferable property. The reason is not clear; however, probably this is because optical-electron interaction appears on a contact interface of the particles of the charge generating substance.

Figure 2:
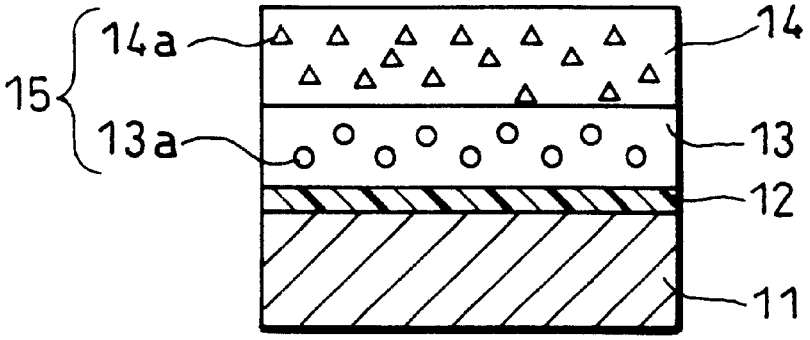
FIG. 2 is a sectional view schematically showing a construction of an electrophotographic photosensitive element having an intermediate layer as variation of the laminated electrophotographic photosensitive element shown in FIG. 1.
Figure 3:
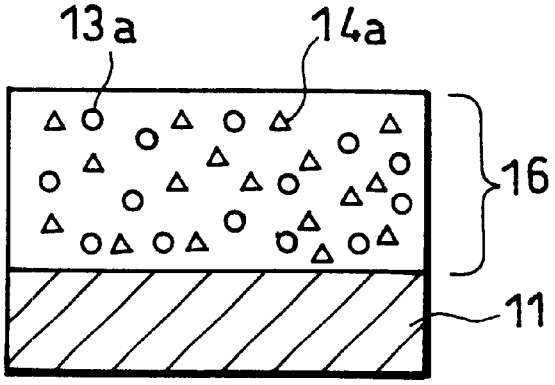
FIG. 3 is a sectional view schematically showing the construction of a single-layer electrophotographic photosensitive element in accordance with other example of the present invention.

Referring to FIGS. 1 through 3, the following explanation describes the detail of the photosensitive element.

The photosensitive element of the present invention includes (a) a single-layer photosensitive element in which charge is generated and transported in the same layer of the photosensitive layer, and (b) a laminated (divided by function) photosensitive element in which charge is generated and transported in different layers of the photosensitive layer.

As shown in FIG. 1, the laminated photosensitive element of the present invention has a photosensitive layer 15, in which a) a charge generating layer (charge appearing layer) 13 containing the charge generating substance 13*a* and b) a charge transport layer 14 containing a charge transport substance 14*a* are stacked on a conductive support 11.

Moreover, as shown in FIG. 2, in the laminated photosensitive element, an intermediate layer (undercoating layer) 12 can be further provided, in which metal particles or metal oxide particles and the like serving as conductive powder are dispersed into a binding agent for the intermediate layer (binder resin, etc.), between the conductive support 11 and the photosensitive layer 15.

To be specific, the charge generating layer 13 has a construction in which X-type metal-free phthalocyanine serving as the charge generating substance 13*a* and the disazo compound shown in the general formula (1) are dispersed into a binding agent (binder) for the charge generating layer. The charge generating layer 13 is formed as follows: these compositions (the charge generating substance 13*a* and the binding agent for the charge generating layer) are dispersed and solved in a suitable solvent for the charge generating layer (solvent for dispersing a charge generating substance, hereinafter, referred to as solvent A) so as to prepare a coating for the charge generating layer, and then, the coating is applied to the conductive support 11 or the intermediate layer 12 and is dried.

To be specific, the charge generating layer 13 is formed by the following methods. 1) The particles of the charge generating substance 13*a* are dispersed into solution obtained by solving the binding agent for the charge generating layer into the suitable solvent A, so as to prepare the coating for the charge generating layer, and then, the coating is applied onto the conductive support 11 or the intermediate layer 12 and is dried. 2) The particles of the charge generating substance 13*a* are previously dispersed in the suitable solvent A, and then, the binding agent for the charge generating layer is solved in the agent A so as to prepare the coating for the charge generating layer, and the coating is applied onto the conductive support 11 or the intermediate layer 12 and is dried. 3) The X-type metal-free phthalocyanine and the disazo compound are separately dispersed in the solvents A, and then, the dispersed solvents are mixed with each other so as to prepare the coating for the charge generating layer, and the coating is applied onto the conductive support 11 or the intermediate layer 12 and is dried. The method is not particularly limited to these. Additionally, when the X-type metal-free phthalocyanine and the disazo compound are dispersed in a single unit of the solvent A, the order and others are not particularly limited.

When the binding agent for the charge generating layer is solved in the solvent A and/or when the charge generating substance 13*a* is dispersed in the solvent A, it is possible to use equipment such as a ball mill, a paint shaker, a sand mill, and a Dinor-mill as well as an ultrasonic dispersing apparatus. With such equipment, the charge generating substance 13*a* can be simultaneously mixed and ground (milling operation is also available).

Here, the X-type metal-free phthalocyanine and the disazo compound are applied to the same solvent A (namely, under coexistence of the X-type metal-free phthalocyanine and the disazo compound) and are ground at the same time. And then, the resultant product is preferably used as the coating for the charge generating layer, so that the completed photosensitive element has higher sensitivity and stability. The reason is not clear. However, probably this is because interaction is easily achieved among the charge generating substances 13*a* so as to improve the property. Moreover, the same effect can be achieved by simultaneously grinding the X-type metal-free phthalocyanine and the disazo compound (under coexistence) before being applied into the solvent A.

To be specific, as the binding agent for the charge generating layer, it is possible to adopt a binder resin selected from polyamide, polyurethane, epoxy resin, polycarbonate resin, silicone resin, acrylic resin, polyvinyl butyral resin, polyvinyl formal, polystirene, polyacrylamide, polyester, phenoxy resin, vinyl chloride-vinyl acetate copolymer, vinyl chloride-vinyl acetate-maleic anhydride copolymer, vinyl chloride-vinyl acetate-vinyl alcohol copolymer, polyvinyl acetate, polyvinyl alcohol; protein such as casein; and other materials. However, the material is not particularly limited. As the binding agent for the charge generating layer, when using vinyl chloride-vinyl acetate copolymers resin such as vinyl chloride-vinyl acetate copolymer, vinyl chloride-vinyl acetate-maleic anhydride copolymer, and vinyl chloride-vinyl acetate-vinyl alcohol copolymer, a favorable result can be obtained particularly concerning sensitivity. Especially, vinyl chloride-vinyl acetate-maleic anhydride copolymer can achieve a further desirable result. The reason why vinyl chloride-vinyl acetate copolymers resin can achieve a favorable result is not clear. However, probably this is because of an electronic property being peculiar to the copolymer, or a structure in a matrix form.

As the solvent A for dispersing and solving the charge generating substance 13*a* and the binding agent for the charge generating layer, it is possible to adopt a material selected from isopropyl alcohol, cyclohexanone, cyclohexane, toluene, xylene, acetone, methyl ethyl ketone, tetrahydrofran, dioxane, ethyl cellosolve, ethyl acetate, methyl acetate, dichloromethane, dichloroehtane, monochlorobenzene, and ethylene glycol dimethyl ether. It is basically possible to adopt materials other than these. For example, any one of the following solvents or any mixture among the following solvents can be adopted: alcohol solvent, ketone solvent, amide solvent, ester solvent, ether solvent, hydrocarbon solvent, chlorinated hydrocarbons solvent, and aromatic series solvent.

The kind of the solvent A is not particularly limited. However, in view of reduction of sensitivity that is caused by a crystal shift upon grinding and milling the charge generating substance 13*a,* and in view of deterioration in a property that is caused by a pot life, it is desirable that the solvent A contain any one of cyclohexanone, methyl ethyl ketone, and tetrahydrofran, that hardly cause a crystal shift in the disazo compound and the X-type metal-free phthalocyanine.

The mixture ratio of the X-type metal-free phthalocyanine and the disazo compound is not particularly limited. However, it is more desirable that 10 to 70 parts by weight of the disazo compound is contained relative to 100 parts by weight of the X-type metal-free phthalocyanine. The mixture ratio of the disazo compound is set within this range so as to effectively prevent reduction in sensitivity that is caused by the shortage of the disazo compound, reduction in charge, and especially reduction in charge in the case of frequent reuse.

Furthermore, relative to the binding agent for the charge generating layer, a total amount of the X-type metal-free phthalocyanine and the disazo compound is not particularly limited. However, when the mixture ratio of the X-type metal-free phthalocyanine and the disazo compound is within the above range, the total amount is preferable between 100 and 400 parts by weight and is further preferable between 100 and 200 parts by weight, relative to 100 parts by weight of the binding agent for the charge generating layer.

The X-type metal-free phthalocyanine and the disazo compound are preferably used in particles. The (second) median diameter of the particle is not particularly limited; however, the diameter is preferable at 1.0 $\mu$m or less and is more preferable at 0.7 $\mu$m or less. The median diameter indicates a diameter of a particle, in which regarding a weight or number reference, an accumulated value of particle size distributions is 50%. The weight or number of a particle having a diameter larger than the median diameter is the same as that of a particle having a diameter shorter than the median diameter.

The median diameter is set within the above range so as to improve a possibility of contact between X-type metal-free phthalocyanine particles and disazo compound particles and to effectively prevent reduction in charge of the photosensitive element. It is therefore possible to further improve the effect of enhancing sensitivity by co-dispersing the particles.

Moreover, the thickness of the charge generating layer 13 is not particularly limited; however, the thickness is preferably set between 0.01 $\mu$m and 5 $\mu$m and is more preferably set between 0.1 $\mu$m and 2 $\mu$m.

Further, in some cases, the charge generating layer 13 can be made only of the X-type metal-free phthalocyanine and the disazo compound. Namely, the charge generating layer 13 can be formed without using the binding agent for the charge generating layer by adopting a method of evaporating the charge generating material 13*a* on the conductive support 11 or the intermediate layer 12. Moreover, dispersion is prepared by dispersing the particles of the charge generating substance 13*a* into the aforementioned solvent A, and the dispersion is applied and dried on the conductive support 11, so that the charge generating layer 13 can be formed without using the binding agent for the charge generating layer.

Furthermore, in some cases, besides the disazo compound and the X-ray metal-free phthalocyanine, a sensitizing agent and other charge generating substances can be dispersed onto the charge generating layer 13.

The charge transport layer 14 can be formed as follows: the charge transport substance 14*a* and a binding agent for the charge transport layer (binder resin and the like) are dispersed and solved into a suitable solvent for the charge transport layer (hereinafter, referred to as a solvent B), and the solvent B is applied and dried on the charge generating layer 13. Further, it is possible to add an agent such as a plasticizer, a leveling agent, and an anti-oxidizing agent to the charge transport layer 14 if necessary. Additionally, for example, when the charge transport layer is made of polymeric charge transport substances such as a PVK, a binding agent for the charge transport layer is not particularly necessary for binding the charge transporting substance.

As the binding agent for the charge transport layer, it is possible to adopt the same material as the binding agent for the charge generating layer. Moreover, as the solvent B, it is possible to adopt the same solvent as the solvent A described in the explanation on the charge generating layer 13. The amount of the charge transport substance 14*a* is not particularly limited; however, the amount is preferable between 30 and 200 parts by weight relative to 100 parts by weight of the binding agent for the charge transport layer, and further preferable between 40 and 150 parts by weight. Further, the thickness of the charge transport layer 14 is not particularly limited; however, the thickness is preferable between 5 and 40 $\mu$m and is more preferable between 10 and 40 $\mu$m.

As the leveling agent, it is possible to adopt a material selected from silicon oils and a polymer or an oligomer which has a perfluoro-alkyl on its side chain. The amount of the leveling agent is not particularly limited; however, the amount is preferable at less than 1 part by weight relative to 100 parts by weight of the binding agent for the charge transport layer. Further, as the anti-oxidizing agent, it is possible to adopt an anti-oxidizing agent made of a material selected from a hindered phenols compound, a phosphors compound, a sulfurs compound, and a hindered amines compound, that are generally added to a resin. The amount of the applied anti-oxidizing agent is not particularly limited; however, the amount is preferable at less than 10 parts by weight and more preferable at less than 5 parts by weight, relative to 100 parts by weight of the binding agent for the charge transport layer.

Here, the order of stacking the charge generating layer 13 and the charge transport layer 14 is not particularly limited. Namely, in the laminated photosensitive element of the present invention, any one of the charge generating layer 13 and the charge transport layer 14 can serve as an upper layer.

The intermediate layer 12 is normally formed by dispersing conductive powder into a suitable binding agent for the intermediate layer (binder resin and the like). For example, 1) adhesion is improved between the conductive support 11 and the photosensitive layer 15 and 2) supply of charge (electrical charge) from the conductive support 11 is controlled, so that the intermediate layer 12 has functions of preventing reduction in a charge potential in the case of frequent reuse and preventing an increase in a remained potential so as to improve the electrostatic property of the photosensitive element.

It is not particularly necessary to provide the intermediate layer 12 in the photosensitive element of the present invention. However, with the intermediate layer 12, even when the charge generating layer 13 tends to generate excessive charge, it is possible to effectively prevent reduction in a repeating property that may be caused by supplying excessive charge from the charge generating layer 13 to the conductive support 11.

As the conductive powder, it is possible to adopt, for example, metal powder made of materials selected from nickel, iron, zinc, a nickel chrome alloy (dichromatic), copper, aluminum, carbon black, and silver; conductive metal oxide powder made of materials such as conductive titanium oxide, conductive tin oxide, and ITO (Indium-Tin Oxide); and others. However, the materials are not particularly limited.

Moreover, as the binding agent for the intermediate layer, it is possible to adopt materials including water-soluble, alcohol-soluble, thermoplastic, thermosetting resins and photo-curing resins selected from polyethylene, polypropylene, polystirene, aclyric resin, polyvinyl chloride, polyvinyl acetate, polyester, silicon resin, polyvinyl butyral, polyamide, copolymer of the above resins (for example, polyvinyl chloride-vinyl acetate copolymer), stirene-acrylonitrile copolymer, stirene-butadiene copolymer, stirene-maleic anhydride copolymer, polyvinyl alcohol, polyarylate, phenoxy resin, polycarbonate, epoxy resin, melamine resin, (poly)urethane resin, phenol resin, alkyd resin, and alkyd-melamine resin; protein such as casein and gelatin; and ester cellulose and the like. However, the materials are not particularly limited, so that the materials can be chosen as necessary in accordance with the kind of the dispersed conductive powder and the like.

Furthermore, in order to eliminate moire, to reduce a remained potential, and to prevent a defect on an image, that cause a problem in a property of the photosensitive element, if necessary, it is also possible to add particles of metallic oxides such as titanic oxide, tin oxide, and aluminum oxide (alumina), and particles of metallic oxides that are subjected to surface treatment by using a silane coupling agent, a titan coupling agent, a chrome coupling agent, and others.

The method for forming the intermediate layer 12 (described later) is not particularly limited. For example, it is possible to adopt a method such as 1) a method for applying and drying dispersion, which is obtained by dispersing the conductive powder and the like into the binding agent for the intermediate layer, on the conductive support 11, and 2) a method for dispersing the conductive powder and the like and the binding agent for the intermediate layer into suitable solvent C before applying and drying the solvent C onto the conductive support 11. Here, the thickness of the intermediate layer 12 is not particularly limited; however, the thickness is preferable at less than 5 $\mu$m. Further, in some cases, the intermediate layer 12 can be constituted merely by the binding agent for the intermediated layer.

The following explanation describes the single-layer photosensitive element. For instance, as shown in FIG. 3, the single-layer photosensitive element of the present invention has a construction in which the above-mentioned charge generating substance 13*a* and the charge transport substance 14*a* are dispersed into a single photosensitive layer 16 provided on the conductive support 11. The charge generating substance 13*a* and the charge transport substance 14*a* are normally dispersed into a binder resin serving as a binding agent (coupling agent) for the photosensitive layer.

As the charge generating substance 13*a,* it is possible to adopt the X-type metal-free phthalocyanine and the disazo compound represented by the general formula (1). As the charge transport substance 14*a,* it is possible to adopt the compound described in the explanation on the laminated photosensitive element.

As the binding agent for the photosensitive layer, it is possible to adopt the binding agent for the charge transport layer (or the binding agent for the charge generating layer) described in the explanation on the laminated photosensitive element. As the binding agent for the photosensitive layer, a polyvinyl chloride-vinyl acetate copolymers resin are more preferable.

The median particle diameter of the charge generating substance is not particularly limited; however, the median diameter is preferable at 1.0 $\mu$m or less and more preferable at 0.7 $\mu$m or less.

Furthermore, the amounts of the mixed charge generating substance 13*a* and the mixed charge transport substance 14*a* are not particularly limited. However, the amount of the charge generating substance 13*a* is preferable between 3 and 30 parts by weight, and the amount of the charge transport substance 14*a* is between 50 and 150 parts by weight, relative to 100 parts by weight of the binding agent for the photosensitive layer.

The single-layer photosensitive element can be manufactured as follows: firstly, the charge generating substance 13*a* and the charge transport substance 14*a* are dispersed into solution, which is obtained by solving the binding agent for the photosensitive layer into suitable solvent (solvent for dispersing a charge generating substance) D, so as to prepare dispersion. And then, the dispersion is applied onto the conductive support 11 and is dried so as to form the photosensitive layer 16. The kind of the solvent D is not particularly limited. For example, it is possible to adopt the same solvent as the solvent A described in the explanation on the laminated photosensitive layer. Here, for example, when polymeric charge transport substances such as a PVK (polyvinyl carbazole) are used, the charge transport substance can also act as a binding agent for the photosensitive layer, so that the binding agent is not particularly necessary.

In a process in which the charge generating substance 13*a,* the charge transport substance 14*a* and the binding agent for the photosensitive layer are dispersed and solved into the suitable solvent D so as to prepare the dispersion, a dispersing device and the like can be used. When the dispersing device is used, it is more preferable to disperse the disazo compound into the solvent D under the coexistence of the X-type metal-free phthalocyanine.

Furthermore, when the dispersion is applied onto the conductive support 11, it is possible to adopt a method such as a dip applying method and a method for using an instrument such as a spray coat and an applicator. The thickness of the photosensitive layer 16 is not particularly limited; however, it is more preferable between 5 and 40 $\mu$m.

It is possible to add materials such as other charge generating substances, a plasticizer, a leveling agent, and an anti-oxidizing agent to the photosensitive layer 16 if necessary. Additionally, if necessary, an intermediate layer can be provided between the conductive support 11 and the photosensitive layer 16.

Moreover, FIGS. 1 and 2 show the negatively charged photosensitive element, and FIG. 3 shows a positively charged photosensitive element. These charge properties are not particularly limited. Namely, the charge transport substance 14*a* is changed if necessary so as to vary the charge properties.

The following examples and comparative examples discuss the detail of the present invention. The construction of the present invention is not limited to these examples.

Firstly, the following explanation describes a method for measuring properties (electrostatic property and repeating property) of the photosensitive element, which is evaluated in the following examples and comparative examples.

The electrostatic property of the photosensitive element is measured by EPA-8200 (manufactured by Kawaguchi Electric Seisakusho, Ltd.) in a static mode.

To be specific, a voltage of corona discharge is adjusted so as to set a surface potential (Vo) of the photosensitive element at 500V. And then, a band path filter is used to expose light having a wavelength of 780 nm so as to measure exposure amount required for a surface potential of 250V: E/2 ($\mu$J/cm$^2$) and exposure amount required for a surface potential of 100V: E/5($\mu$J/cm$^2$).

Moreover, the repeating property of the photosensitive element is evaluated as follows: the photosensitive element is attached to an aluminum tube and is incorporated into a copying machine (AR-5130: manufactured by Sharp Corp.). And then, 5000 copies are successively made to measure a change in charge potential ($\Delta$Vo), a change in potential after exposure ($\Delta$VL), and a change in remained potential ($\Delta$Vr), before and after an operation of the copying machine. Additionally, regarding the corona discharge voltage of EPA-8200 and AR-5130 (copying machines), negative discharge is used for the laminated photosensitive element, and positive discharge is used for the single-layer photosensitive element.

EXAMPLE 1

3 parts by weight of an X-type metal-free phthalocyanine (Fastagen Blue: manufactured by Dainippon Ink & Chemicals Inc.) and 2 parts by weight of disazo pigment (disazo compound, hereinafter, referred to as disazo compound (1)), which is represented by the aforementioned chemical structural formula (8), are added to 195 parts by weight of THF (tetrahydrofuran) serving as solvent D, and then, the solvent D is dispersed for 48 hours by using a ball mill so as to prepare pigment dispersion E.

Next, 100 parts by weight of Z-type polycarbonate resin (TS-2050: manufactured by Teijin Kasei Ltd.) serving as a binding agent for a photosensitive layer, 100 parts by weight of a charge transport substance (hereinafter, referred to as charge transport substance (1)) represented by the following chemical structural formula (12), and 0.02 parts by weight of silicon oil are dispersed and solved into 467 parts by weight of THF serving as the solvent D so as to prepare resin solution F.

(12)

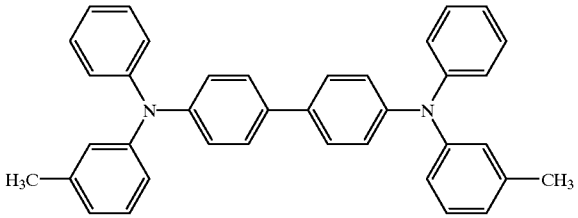

And then, the pigment dispersion E and the resin solution F are mixed with each other such that the weight ratio is 1:2, and the mixed solution is dispersed for 2 hours by using a ball mill so as to prepare a coating for the photosensitive layer (hereinafter, referred to as a coating).

The coating prepared in the above process is formed into a film with a thickness of 30 $\mu$m on a PET (polyethylene terephthalate) film (conductive support), on which aluminum layer is formed due to vapor deposition, by using an applicator, and then, the film is dried at 80° C. for one hour so as to complete a sheet-type electrophotographic photosensitive element (single layer). And then, the properties of the photosensitive element are measured.

Regarding the properties of the photosensitive element, the measurement results and others are shown in Table 1 together with the results of Embodiments 2–12 and Comparative Example 1.

EXAMPLES 2–12

A photosensitive element is manufactured and the properties thereof are evaluated with the same operations and conditions as those of Example 1, except that the combination of a disazo pigment (disazo compound) serving as a charge generating material and a charge transport substance is changed as shown in Table 1. The property evaluation results of the photosensitive element are also shown in Table 1. Here, in the following Table 1, charge transport substances (2)–(9) respectively correspond to materials represented in the following general formulas (13)–(20).

(13)

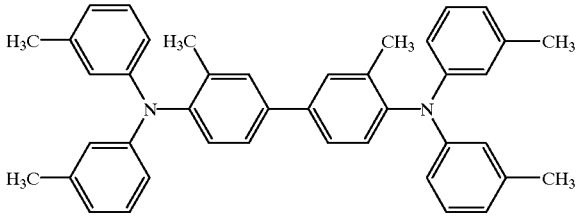

(14)

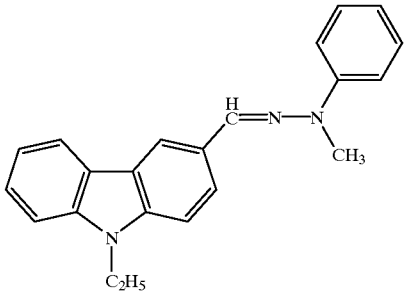

(15)

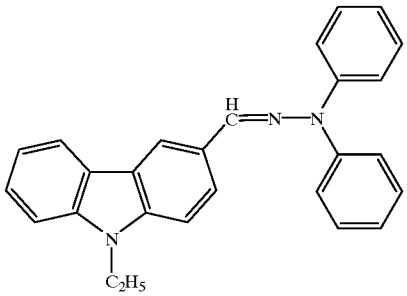

-continued (16)

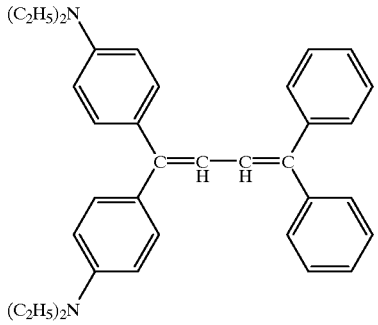

(17)

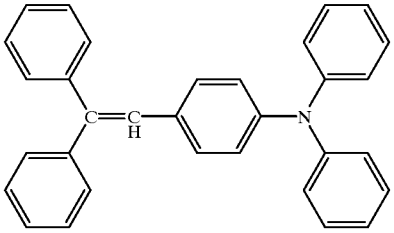

(18)

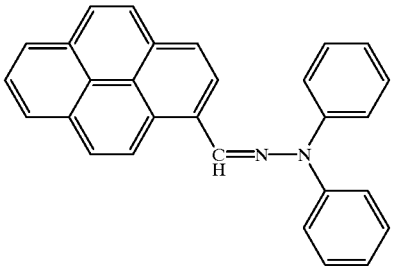

(19)

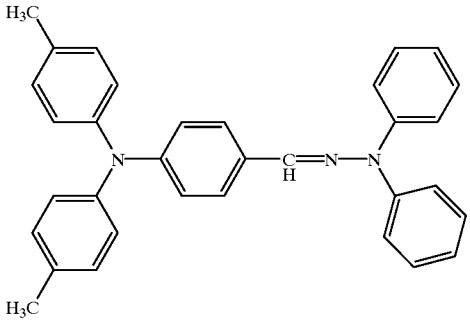

(20)

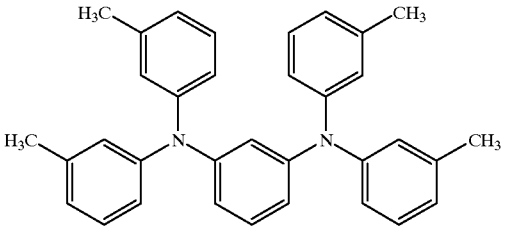

COMPARATIVE EXAMPLE 1

As shown in the following Table 1, a photosensitive element is manufactured and the properties thereof are evaluated with the same operations and conditions as those of Example 1, except that a disazo compound (1) is omitted. The property evaluation results of the photosensitive element are also shown in the following Table 1.

Moreover, the coating for the charge transport layer is formed into a film with a thickness of 20 μm on the charge generating layer by using an applicator, and then, the film is dried at 80° C. for one hour so as to complete a sheet-type electrophotographic photosensitive element (laminated) of the present invention. Afterwards, the properties of the photosensitive element are measured.

TABLE 1

| | DISAZO COMPOUND | CHARGE TRANSPORT MATERIAL | INITIAL SENSITIVITY (μJ/cm²) E/2 | E/5 | REPEATING PROPERTY (V) ΔVo | ΔVL | ΔVr |
|---|---|---|---|---|---|---|---|
| EXAMPLE 1 | (1) | (1) | 0.63 | 1.52 | −89 | −30 | 65 |
| EXAMPLE 2 | (1) | (2) | 0.59 | 1.49 | −72 | −39 | 72 |
| EXAMPLE 3 | (1) | (3) | 0.64 | 1.49 | −80 | −28 | 69 |
| EXAMPLE 4 | (1) | (4) | 0.65 | 1.42 | −63 | −32 | 71 |
| EXAMPLE 5 | (1) | (5) | 0.69 | 1.55 | −71 | −31 | 71 |
| EXAMPLE 6 | (1) | (6) | 0.60 | 1.41 | −69 | −33 | 68 |
| EXAMPLE 7 | (1) | (7) | 0.58 | 1.32 | −73 | −34 | 59 |
| EXAMPLE 8 | (1) | (8) | 0.63 | 1.39 | −81 | −28 | 52 |
| EXAMPLE 9 | (1) | (9) | 0.62 | 1.38 | −63 | −31 | 53 |
| EXAMPLE 10 | (2) | (1) | 0.58 | 1.35 | −72 | −28 | 63 |
| EXAMPLE 11 | (3) | (1) | 0.63 | 1.42 | −73 | −34 | 58 |
| EXAMPLE 12 | (4) | (1) | 0.67 | 1.55 | −80 | −38 | 63 |
| COMPARATIVE EXAMPLE 1 | — | (1) | 0.94 | 1.95 | −135 | −32 | 89 |

As shown in Table 1, the photosensitive element (of the present invention), which has a photosensitive layer containing the disazo compound represented by the above general formula (1) together with X-type metal-free phthalocyanine, is more superior in sensitivity and stability of an electrostatic property (particularly a change in charge voltage (ΔVo) and a change in a remained potential (ΔVr) before and after an operation of a copying machine) even in the case of frequent reuse, as compared with the photosensitive element (Comparative Example 1) which does not contain the disazo compound.

EXAMPLE 13

15 parts by weight of X-type metal-free phthalocyanine, 10 parts by weight of the disazo compound (1), and 10 parts by weight of butyral resin (polyvinyl butyral) (S-LEC BL-2: manufactured by Sekisui Chemical Co., Ltd.) serving as a binding agent for a charge generating layer are added to 1400 parts by weight of methyl ethyl ketone serving as solvent A, and then, the solvent A is dispersed for 48 hours by using a ball mill so as to prepare a coating for the charge generating layer.

Further, the coating for the charge generating layer is formed into a film with a thickness of 0.2 μm on a PET film (conductive support), on which aluminum layer is formed due to vapor deposition, by using an applicator, and then, the film is dried so as to complete the charge generating layer.

Next, 100 parts by weight of polycarbonate resin (C-1400: manufactured by Teijin) serving as a binding agent for a charge transport layer, 100 parts by weight of the charge transport substance (1), and 0.02 parts by weight of silicon oil are dispersed and solved in 1000 parts by weight of dichloromethane serving as solvent B so as to prepare a coating for the charge transport layer.

Additionally, particle diameters of the X-type metal-free phthalocyanine and the disazo compound (1), that are contained in the charge generating layer, are measured as follows: a second particle median diameter of the coating for the charge generating layer is measured (measurement of particle size distribution) by using a centrifugal settling size distribution analyzer (manufactured by Shimadzu Corp.).

Regarding the properties of the photosensitive element, the measurement results and others are shown in the following Tables 2 and 3 together with the results of Examples 14–24 and Comparative Example 2.

EXAMPLES 14–24

A photosensitive element is manufactured and the properties thereof are evaluated with the same operations and conditions as those of Example 13, except that the combination of a disazo pigment (disazo compound) serving as a charge generating material and a charge transport substance is changed as shown in Table 2, and except that time for dispersion using a ball mill is changed as shown in Table 2. The property evaluation results of the photosensitive element are also shown in Tables 2 and 3.

COMPARATIVE EXAMPLE 2

As shown in Tables 2 and 3, a photosensitive element is manufactured and the properties thereof are evaluated with the same operations and conditions as those of Example 13, except that the disazo compound (1) is omitted and time for dispersion using a ball mill is changed. The property evaluation results of the photosensitive element are also shown in Tables 2 and 3.

TABLE 2

| | DISAZO COMPOUND | CHARGE TRANSPORT SUBSTANCE | DISPERSION TIME (hr) | PARTICLE DIAMETER (μm) |
|---|---|---|---|---|
| EXAMPLE 13 | (1) | (1) | 72 | 0.35 |
| EXAMPLE 14 | (2) | (1) | 72 | 0.35 |
| EXAMPLE 15 | (2) | (1) | 8 | 0.85 |
| EXAMPLE 16 | (2) | (1) | 22 | 0.55 |
| EXAMPLE 17 | (2) | (1) | 48 | 0.42 |
| EXAMPLE 18 | (3) | (1) | 72 | 0.35 |
| EXAMPLE 19 | (4) | (1) | 72 | 0.35 |
| EXAMPLE 20 | (4) | (2) | 72 | 0.35 |
| EXAMPLE 21 | (4) | (4) | 72 | 0.35 |
| EXAMPLE 22 | (4) | (5) | 72 | 0.35 |
| EXAMPLE 23 | (4) | (8) | 72 | 0.35 |
| EXAMPLE 24 | (4) | (9) | 72 | 0.35 |
| COMPARATIVE EXAMPLE 2 | — | (1) | 72 | 0.35 |

TABLE 3

| | INITIAL SENSITIVITY ($\mu J/cm^2$) | | REPEATING PROPERTY (V) | | |
|---|---|---|---|---|---|
| | E/2 | E/5 | ΔVo | ΔVL | ΔVr |
| EXAMPLE 13 | 0.36 | 0.82 | −43 | −23 | 32 |
| EXAMPLE 14 | 0.37 | 0.83 | −39 | −28 | 29 |
| EXAMPLE 15 | 0.41 | 0.99 | −59 | −32 | 37 |
| EXAMPLE 16 | 0.38 | 0.92 | −45 | −25 | 33 |
| EXAMPLE 17 | 0.36 | 0.86 | −39 | −30 | 30 |
| EXAMPLE 18 | 0.35 | 0.79 | −41 | −25 | 33 |
| EXAMPLE 19 | 0.39 | 0.93 | −32 | −33 | 35 |
| EXAMPLE 20 | 0.35 | 0.81 | −42 | −32 | 21 |
| EXAMPLE 21 | 0.36 | 0.88 | −39 | −31 | 28 |
| EXAMPLE 22 | 0.38 | 0.93 | −37 | −29 | 33 |
| EXAMPLE 23 | 0.37 | 0.85 | −43 | −30 | 35 |
| EXAMPLE 24 | 0.37 | 0.81 | −35 | −27 | 25 |
| COMPARATIVE EXAMPLE 2 | 0.51 | 1.12 | −75 | −31 | 38 |

As shown in Tables 2 and 3, the photosensitive element of the present invention is more superior in sensitivity and stability of an electrostatic property (particularly a change in charge voltage (ΔVo) and a change in remained potential (ΔVr) before and after an operation of a copying machine) even in the case of frequent reuse, as compared with the photosensitive element (Comparative Example 2) which does not contain the disazo compound represented by the above general formula (1).

Further, according to the results of Examples 14–17, regarding the charge generating material, the smaller a (second) particle median diameter is, the more sensitivity and the more stable electrostatic property are achieved even in the case of frequent reuse.

EXAMPLE 25

5 parts by weight of the disazo compound (1) and 5 parts by weight of butyral resin (S-LEC BL-2) serving as a binding agent for a charge generating layer are added to 700 parts by weight of methyl ethyl ketone serving as solvent A, and then, the solvent A is dispersed for 72 hours by using a ball mill so as to prepare pigment dispersion G. And then, 7.5 parts by weight of X-type metal-free phthalocyanine and 5 parts by weight of butyral resin (S-LEC BL-2) serving as the binding agent for the charge generating layer are added to 700 parts by weight of methyl ethyl ketone serving as the solvent A, and then, the solvent is dispersed for 72 hours by using a ball mill so as to prepare pigment dispersion H. Moreover, the pigment dispersions G and H are mixed with each other for 2 hours by using a ball mill so as to prepare a coating for the charge generating layer.

The coating for the charge generating layer is formed into a film with a thickness of 0.2 μm on a PET film (conductive support), on which an aluminum layer is formed due to vapor deposition, by using an applicator, and then, the film is dried so as to complete the charge generating layer.

Next, 100 parts by weight of polycarbonate resin (C-1400) serving a binding agent for a charge transport layer, 100 parts by weight of the charge transport substance (1), and 0.02 parts by weight of silicon oil are dispersed and solved in 1000 parts by weight of dichloromethane so as to prepare a coating for the charge transport layer.

Moreover, the coating for the charge transport layer is formed into a film with a thickness of 20 μm on the charge generating layer by using an applicator, and then, the film is dried at 80° C. for one hour so as to complete a sheet-type electrophotographic photosensitive element (laminated) of the present invention. Afterwards, the properties of the photosensitive element are measured.

Regarding the properties of the photosensitive element, the measurement results and others are shown in the following Table 4 together with the results of Examples 26–33.

EXAMPLES 26–33

A photosensitive element is manufactured and the properties thereof are evaluated with the same operations and conditions as those of Example 25, except that the combination of a disazo pigment (disazo compound) serving as a charge generating substance and a charge transport substance is changed as shown in Table 4. The property evaluation results of the photosensitive element are also shown in Table 4.

TABLE 4

| | DISAZO COMPOUND | CHARGE TRANSPORT MATERIAL | INITIAL SENSITIVITY ($\mu$J/cm$^2$) E/2 | E/5 | REPEATING PROPERTY (V) ΔVo | ΔVL | ΔVr |
|---|---|---|---|---|---|---|---|
| EXAMPLE 25 | (1) | (1) | 0.38 | 0.82 | −43 | −25 | 33 |
| EXAMPLE 26 | (2) | (1) | 0.39 | 0.83 | −43 | −28 | 31 |
| EXAMPLE 27 | (3) | (1) | 0.37 | 0.79 | −44 | −27 | 35 |
| EXAMPLE 28 | (4) | (1) | 0.41 | 0.93 | −38 | −35 | 36 |
| EXAMPLE 29 | (2) | (2) | 0.39 | 0.87 | −33 | −31 | 29 |
| EXAMPLE 30 | (2) | (4) | 0.39 | 0.88 | −37 | −28 | 33 |
| EXAMPLE 31 | (4) | (5) | 0.40 | 0.93 | −41 | −33 | 27 |
| EXAMPLE 32 | (4) | (8) | 0.39 | 0.85 | −40 | −31 | 34 |
| EXAMPLE 33 | (4) | (9) | 0.39 | 0.87 | −39 | −33 | 26 |

The electrophotographic photosensitive elements of Examples 13 to 24 are formed by simultaneously grinding the disazo compound and the X-type metal-free phthalocyanine under coexistence with each other. The electrophotographic photosensitive elements of Examples 25 to 33 are formed by initially grind the pigments in a separate manner and mixing them. As shown in FIG. 4, the electrophotographic photosensitive elements of Examples 25 to 33 do not cause any serious problems as compared with the electrophotographic photosensitive elements of Examples 13 to 24. However, the former is slightly inferior to the latter in the initial sensitivity (E/2) and stability (ΔVo). For this reason, it is preferable to grind the two kinds of pigments under coexistence with each other.

EXAMPLE 34

5 parts by weight of alcohol-soluble polyamide (CM-8000: manufactured by Toray Industries Inc.) and 2 parts by weight of titanic oxide (ITO-55N: manufactured by Ishihara Sangyo Kaisha, Ltd.) are added to 1000 parts by weight of mixed solution with a 7:3 volume ratio of methyl alcohol and n-butyl alcohol. And then, the solution is dispersed by using a paint shaker so as to prepare a coating for an intermediate layer.

Further, the coating for the intermediate layer is formed into a film with a thickness of 1 $\mu$m on a PET film (conductive support), on which an aluminum layer is formed due to vapor deposition, by using an applicator, and then, the film is dried so as to complete the intermediate layer.

And then, 15 parts by weight of X-type metal-free phthalocyanine, 10 parts by weight of the disazo compound (1), and 10 parts by weight of butyral resin (S-LEC BL-2) serving as a binding agent for a charge generating layer are added to 1400 parts by weight of methyl ethyl ketone serving as solvent A, and then, the solvent is dispersed for 72 hours by using a ball mill so as to prepare a coating for a charge generating layer. Next, the coating for the charge generating layer is formed into a film with a 0.2 $\mu$m on the intermediate layer by using an applicator and is dried so as to complete the charge generating layer.

Next, 100 parts by weight of polycarbonate resin (C-1400: manufactured by Teijin ) serving a binding agent for a charge transport layer, 100 parts by weight of the charge transport substance (1), and 0.02 parts by weight of silicon oil are dispersed and solved in 1000 parts by weight of dichloromethane serving as solvent B so as to prepare a coating for the charge transport layer.

Moreover, the coating for the charge transport layer is formed into a film with a thickness of 20 $\mu$m on the charge generating layer by using an applicator, and then, the film is dried at 80° C. for one hour so as to complete a sheet-type electrophotographic photosensitive element (laminated) including the intermediate layer of the present invention. Afterwards, the properties of the photosensitive element are measured.

Regarding the properties of the photosensitive element, the measurement results and others are shown in the following Table 5 together with the results of Examples 35 and 36 and the Comparative Example 3.

EXAMPLES 35–36

A photosensitive element is manufactured and the properties thereof are evaluated with the same operations and conditions as those of Example 34, except that the combination of a disazo pigment (disazo compound) and a charge transport substance is changed as shown in Table 5. The property evaluation results of the photosensitive element are also shown in Table 5.

COMPARATIVE EXAMPLE 3

As shown in the following Table 5, a photosensitive element is manufactured and the properties thereof are evaluated with the same operations and conditions as those of Example 34, except that the disazo compound (1) is omitted. The property evaluation results of the photosensitive element are also shown in the following Table 5.

TABLE 5

| | DISAZO COMPOUND | CHARGE TRANSPORT MATERIAL | INITIAL SENSITIVITY ($\mu$J/cm$^2$) E/2 | E/5 | REPEATING PROPERTY (V) ΔVo | ΔVL | ΔVr |
|---|---|---|---|---|---|---|---|
| EXAMPLE 34 | (1) | (1) | 0.35 | 0.68 | −16 | −31 | 31 |
| EXAMPLE 35 | (2) | (1) | 0.37 | 0.69 | −18 | −29 | 29 |
| EXAMPLE 36 | (3) | (1) | 0.34 | 0.67 | −14 | −33 | 22 |

TABLE 5-continued

| | DISAZO COMPOUND | CHARGE TRANSPORT MATERIAL | INITIAL SENSITIVITY ($\mu J/cm^2$) E/2 | E/5 | REPEATING PROPERTY (V) ΔVo | ΔVL | ΔVr |
|---|---|---|---|---|---|---|---|
| COMPARATIVE EXAMPLE 3 | — | (1) | 0.50 | 1.21 | −55 | −37 | 43 |

As shown in Table 5, the photosensitive element of the present invention is superior in sensitivity and exerts stable electrostatic property even in the case of frequent reuse, as compared with the photosensitive element (Comparative Example 3) which does not contain the disazo compound represented by the aforementioned general formula (1).

EXAMPLES 37–40

A photosensitive element is manufactured and the properties thereof are evaluated with the same operations and conditions as those of Example 34, except that a binding agent for a charge generating layer is changed as shown in Table 6. The property evaluation results of the photosensitive element are also shown in the following Table 6.

Here, in Table 6, S-LEC BM-2, SOLBIN C, SOLBIN A, and SOLBIN TA2 respectively correspond to butyral resin (manufactured by Sekisui Chemical Co., Ltd.), vinyl chloride-vinyl acetate copolymer resin (manufactured by Sekisui Chemical Co., Ltd.), vinyl chloride-vinyl acetate-vinyl alcohol copolymer resin (vinyl chloride-vinyl acetate copolymers resin, manufactured by Sekisui Chemical Co., Ltd.), and vinyl chloride-vinyl acetate-hydroxyalkyl acrylate copolymer resin (vinyl chloride-vinyl acetate copolymers resin, manufactured by Sekisui Chemical Co., Ltd.).

TABLE 6

| | BINDING AGENT FOR CHARGE GENERATING LAYER | INITIAL SENSITIVITY ($\mu J/cm^2$) E/2 | E/5 | REPEATING PROPERTY (V) ΔVo | ΔVL | ΔVr |
|---|---|---|---|---|---|---|
| EXAMPLE 37 | S-LEC BM-2 | 0.34 | 0.71 | −18 | −35 | 33 |
| EXAMPLE 38 | SOLBIN C | 0.29 | 0.59 | −25 | −32 | 28 |
| EXAMPLE 39 | SOLBIN A | 0.30 | 0.61 | −29 | −29 | 31 |
| EXAMPLE 40 | SOLBIN TA2 | 0.31 | 0.60 | −28 | −30 | 40 |

As shown in Table 6, the photosensitive element of the present invention is superior in sensitivity regardless of a kind of the binding agent for the charge transport substance and exerts stable electrostatic property even in the case of frequent reuse. Further, vinyl chloride-vinyl acetate copolymers resin is used as the binding agent for the charge generating layer, so that the sensitivity of the photosensitive element can be further improved.

EXAMPLES 41–49

A photosensitive element is manufactured and the properties thereof are evaluated with the same operations and conditions as those of Example 34, except that composition ratios are changed as shown in the following Table 7, regarding a disazo pigment (disazo compound) and X-type metal-free phthalocyanine relative to 10 parts by weight of a binding agent for a charge generating layer (S-LEC BL-2). The property evaluation results of the photosensitive element are also shown in the following Table 8.

TABLE 7

| | COMPOSITION RATIO X-TYPE METAL-FREE PHTHALOCYANINE | DISAZO COMPOUND |
|---|---|---|
| EXAMPLE 41 | 15.00 | 0.75 |
| EXAMPLE 42 | 15.00 | 1.50 |
| EXAMPLE 43 | 15.00 | 4.50 |
| EXAMPLE 44 | 15.00 | 15.00 |
| EXAMPLE 45 | 5.00 | 3.00 |
| EXAMPLE 46 | 6.00 | 4.00 |
| EXAMPLE 47 | 12.00 | 8.00 |
| EXAMPLE 48 | 24.00 | 16.00 |
| EXAMPLE 49 | 27.00 | 18.00 |

TABLE 8

| | INITIAL SENSITIVITY ($\mu J/cm^2$) E/2 | E/5 | REPEATING PROPERTY (V) ΔVo | ΔVL | ΔVr |
|---|---|---|---|---|---|
| EXAMPLE 41 | 0.49 | 0.98 | −27 | −25 | 41 |
| EXAMPLE 42 | 0.41 | 0.88 | −30 | −32 | 35 |
| EXAMPLE 43 | 0.36 | 0.71 | −23 | −34 | 29 |
| EXAMPLE 44 | 0.30 | 0.62 | −45 | −49 | 33 |
| EXAMPLE 45 | 0.41 | 0.79 | −15 | −31 | 31 |
| EXAMPLE 46 | 0.39 | 0.72 | −18 | −30 | 28 |
| EXAMPLE 47 | 0.35 | 0.69 | −23 | −28 | 18 |
| EXAMPLE 48 | 0.32 | 0.66 | −42 | −42 | 19 |
| EXAMPLE 49 | 0.29 | 0.59 | −49 | −48 | 21 |

As shown in Tables 7 and 8, the photosensitive element of the present invention is in superior in sensitivity regardless of a composition ratio of the charge generating material and exerts stable electrostatic property even in the case of frequent reuse.

EXAMPLES 50–54

A photosensitive element is manufactured and the properties thereof are evaluated with the same operations and conditions as those of Example 34, except that a binding agent for a charge generating layer is changed to SOLBIN M (vinyl chloride-vinyl acetate copolymers resin, manufactured by Sekisui Chemical Co., Ltd.), which is vinyl chloride-vinyl acetate-maleic acid copolymer resin, and except that a charge transport substance is changed as shown in Table 9. The property evaluation results of the photosensitive element are also shown in the following Tables 9 and 10.

TABLE 9

| | CHARGE TRANSPORT | INITIAL SENSITIVITY ($\mu$J/cm$^2$) | |
|---|---|---|---|
| | SUBSTANCE | E/2 | E/5 |
| EXAMPLE 50 | (3) | 0.33 | 0.65 |
| EXAMPLE 51 | (4) | 0.29 | 0.61 |
| EXAMPLE 52 | (5) | 0.31 | 0.59 |
| EXAMPLE 53 | (8) | 0.28 | 0.58 |
| EXAMPLE 54 | (9) | 0.30 | 0.61 |

TABLE 10

| | REPEATING PROPERTY (V) | | |
|---|---|---|---|
| | ΔVo | ΔVL | ΔVr |
| EXAMPLE 50 | −28 | −33 | 21 |
| EXAMPLE 51 | −29 | −29 | 25 |
| EXAMPLE 52 | −32 | −40 | 27 |

TABLE 10-continued

| | REPEATING PROPERTY (V) | | |
|---|---|---|---|
| | ΔVo | ΔVL | ΔVr |
| EXAMPLE 53 | −36 | −39 | 31 |
| EXAMPLE 54 | −34 | −28 | 26 |

As shown in Tables 9 and 10, the photosensitive element of the present invention is superior in sensitivity regardless of a kind of the selected charge transport substance and exerts stable electrostatic property even in the case of frequent reuse.

EXAMPLES 55–66

In Example 55, a photosensitive element is manufactured and the properties thereof are evaluated with the same operations and conditions as those of Example 34, except that a kind of solvent A forming a coating for a charge generating layer is changed, and except that time elapsed between preparing the coating for the charge generating layer and applying the coating onto an intermediate layer is changed, as shown in Tables 11 and 12. Furthermore, in Examples 56–66, a photosensitive element is manufactured and the properties thereof are evaluated with the same operations and conditions as those of Example 34, except that a binding agent for the charge generating layer is changed to SOLBIN M (vinyl chloride-vinyl acetate copolymers resin), and except that a kind of the solvent A is changed, and except that time elapsed between preparing the coating for the charge generating layer and applying the coating onto the intermediate layer is changed, as shown in Table 11. The property evaluation results of the photosensitive element are also shown in the following Tables 11 and 12.

TABLE 11

| | SOLVENT A | TIME ELAPSED SINCE COATING IS PREPARED (DAY) | INITIAL SENSITIVITY ($\mu$J/cm$^2$) | |
|---|---|---|---|---|
| | | | E/2 | E/5 |
| EXAMPLE 55 | METHYL ETHYL KETONE | 30 | 0.35 | 0.71 |
| EXAMPLE 56 | ISOPROPYL ALCOHOL | 0 | 0.37 | 0.70 |
| EXAMPLE 57 | 1,4-DIOXANE | 0 | 0.32 | 0.63 |
| EXAMPLE 58 | DICHLOROMETHANE | 0 | 0.35 | 0.67 |
| EXAMPLE 59 | CYCLOHEXANONE | 0 | 0.28 | 0.59 |
| EXAMPLE 60 | TETRAHYDROFURAN | 0 | 0.28 | 0.62 |
| EXAMPLE 61 | METHYL ETHYL KETONE | 0 | 0.28 | 0.59 |
| EXAMPLE 62 | ISOPROPYL ALCOHOL | 30 | 0.45 | 0.99 |
| EXAMPLE 63 | 1,4-DIOXANE | 30 | 0.39 | 0.89 |
| EXAMPLE 64 | DICHLOROMETHANE | 30 | 0.42 | 0.93 |
| EXAMPLE 65 | CYCLOHEXANONE | 30 | 0.28 | 0.62 |
| EXAMPLE 66 | TETRAHYDROFURAN | 30 | 0.30 | 0.50 |

TABLE 12

| | REPEATING PROPERTY (V) | | |
|---|---|---|---|
| | ΔVo | ΔVL | ΔVr |
| EXAMPLE 55 | −34 | −33 | 29 |
| EXAMPLE 56 | −21 | −31 | 25 |
| EXAMPLE 57 | −31 | −21 | 31 |

TABLE 12-continued

| | REPEATING PROPERTY (V) | | |
|---|---|---|---|
| | ΔVo | ΔVL | ΔVr |
| EXAMPLE 58 | −21 | −21 | 23 |
| EXAMPLE 59 | −16 | −30 | 33 |
| EXAMPLE 60 | −17 | −31 | 19 |
| EXAMPLE 61 | −28 | −37 | 31 |
| EXAMPLE 62 | −23 | −30 | 27 |
| EXAMPLE 63 | −33 | −32 | 27 |
| EXAMPLE 64 | −25 | −32 | 28 |
| EXAMPLE 65 | −19 | −27 | 21 |
| EXAMPLE 66 | −20 | −32 | 31 |

As shown in Tables 11 and 12, any one of the photosensitive elements of the present invention is superior in sensitivity and exerts stable electrostatic property even in the case of frequent reuse. Additionally, when any one of methyl ethyl ketone, cyclohexanone, and tetrahydrofuran is used as the solvent A, the sensitivity of the photosensitive element can be further improved (see Examples 59–61).

Furthermore, it has been generally presumed that the shorter the time elapsed between preparing the coating for the charge generating layer and applying the coating onto the intermediate layer, it is more possible to manufacture a photosensitive element which is superior in sensitivity and stable electrostatic property even in the case of frequent reuse. Particularly, cyclohexanone and tetrahydrofuran can be favorably adopted as the solvent A because the time elapsed between preparing and applying the coating is hardly effected.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic photosensitive element comprising a photosensitive layer containing a charge generating substance and a charge transporting substance on a conductive support, wherein X-type metal-free phthalocyanine and a disazo compound are contained as the charge generating substance, said disazo compound being represented by following general formula (1), (1)

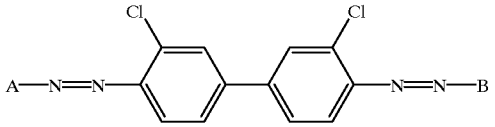

where A and B respectively correspond to any one of coupler remained groups represented by following general formulas (2)–(7), and A and B can also serve as coupler remained groups having the same construction, (2)

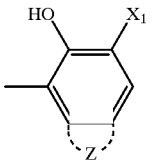

-continued (3)

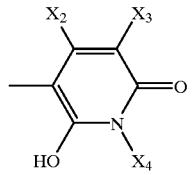

(4)

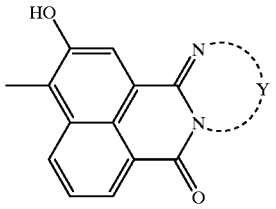

(5)

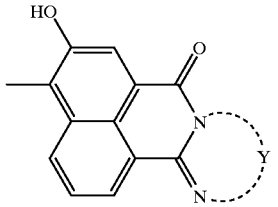

(6)

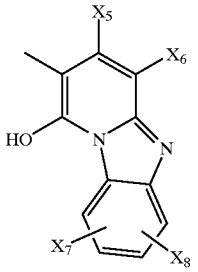

(7)

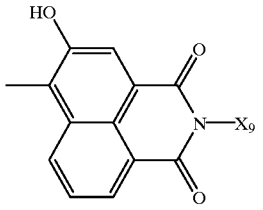

where $X_1$ represents a hydrogen atom or CONHR (R represents a hydrogen atom, an alkyl group, which is allowed to have a substituent, an aryl group, or a heterocyclic group); Z represents a remained group which is condensed with a benzene ring so as to form an aromatic ring or an aromatic heterocycle; $X_2$ and $X_5$ independently represent an alkyl group, which is allowed to have a substituent, an aryl group, or a heterocyclic group; $X_3$ and $X_6$ independently represent a hydrogen atom, a cyano group, a carbamoyl group, a carboxyl group, ester group, or an acyl group; $X_4$ and $X_9$ independently represent a hydrogen atom, an alkyl group, which is allowed to have a substituent, a cycloalkyl group, an alkenyl group, an aralkyl group, an aryl group, or a heterocyclic group; $X_7$ and $X_8$ independently represent a hydrogen atom, a halogen group, a nitro group, an alkyl group, which is allowed to have a substituent, and an alkoxy group; and Y represents a remained group forming an aromatic heterocycle.

2. The electrophotographic photosensitive element as defined in claim 1, wherein said X-type metal-free phthalocyanine and said disazo compound each has a particle median diameter of 1.0 μm or less.

3. The electrophotographic photosensitive element as defined in claim 1, further comprising a binding agent for binding said charge generating substance.

4. The electrophotographic photosensitive element as defined in claim 3, wherein said binding agent is a vinyl chloride-vinyl acetate copolymers resin.

5. The electrophotographic photosensitive element as defined in claim 3, wherein said X-type metal-free phthalocyanine and said disazo compound are co-dispersed into said binding agent.

6. The electrophotographic photosensitive element as defined in claim 1, wherein said disazo compound is represented by following general formula (8).

(8)

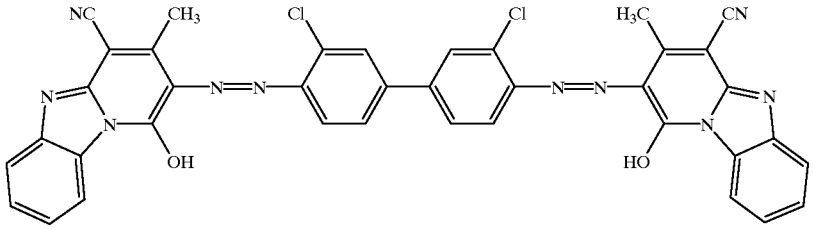

7. The electrophotographic photosensitive element as defined in claim 1, wherein said disazo compound is represented by following general formula (9).

(9)

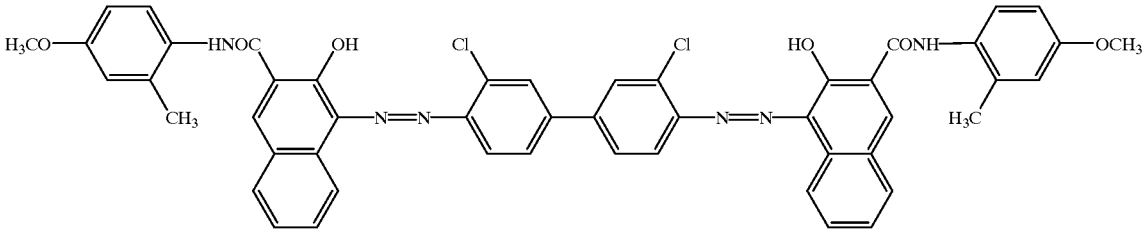

8. The electrophotographic photosensitive element as defined in claim 1, wherein said disazo compound is represented by following general formula (10).

(10)

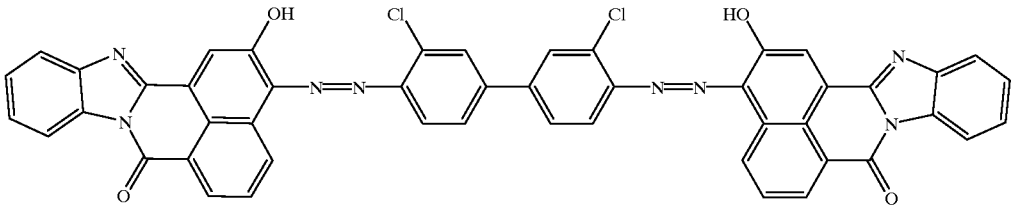

9. The electrophotographic photosensitive element as defined in claim 1, wherein said disazo compound is represented by following general formula (11).

(11)

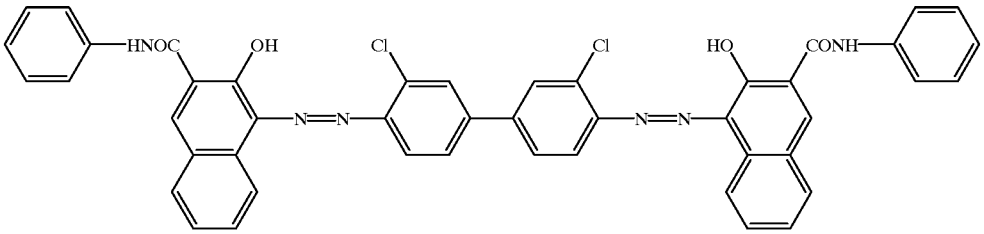

10. The electrophotographic photosensitive element as defined in claim 1, wherein said photosensitive layer has a charge generating layer containing said charge generating substance and a charge transport layer containing said charge transport substance.

11. The electrophotographic photosensitive element as defined in claim 10, wherein said charge generating layer has 10–70 parts by weight of said disazo compound relative to 100 parts by weight of said X-type metal-free phthalocyanine.

12. The electrophotographic photosensitive element as defined in claim 10, wherein said charge transport substance is selected from a group consisting of 2,4,7-trinitro-9-fluorenone, 2,4,5,7-tetranitro-9-fluorenone, 2,4,5,7-tetranitroxanthone, a diphenoquinone derivative, a benzoquinone derivative, a hydrazone derivative, a pyrene derivative, a pyrene-formaldehyde condensate and its derivative, an oxazole derivative, an oxaziazole derivative, an imidazole derivative, a monoarylamine derivative, a diarylamine derivative, a stilbene derivative, an enamine derivative, an α-phenylstilbene derivative, a benzidine derivative, a diarylmethane derivative, a triarylmethane derivative, an anthracene derivative, a pyrazolyne derivative, an indene derivative, a butadiene derivative, a polysilane compound, and a polygermane compound.

13. A manufacturing method for an electrophotographic element, which contains X-type metal-free phthalocyanine and a disazo compound as a charge generating substance, comprising the step of grinding said disazo compound under coexistence with said X-type metal-free phthalocyanine, said disazo compound being represented by following general formula (1), (1)

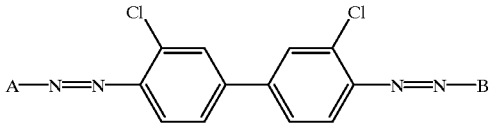

where A and B respectively correspond to any one of coupler remained groups represented by following general formulas (2)–(7), and A and B can also serve as coupler remained groups having the same construction, (2)

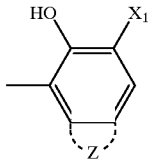

(3)

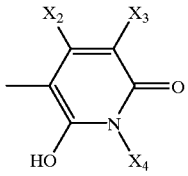

-continued (4)

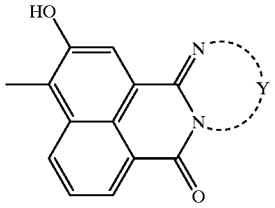

(5)

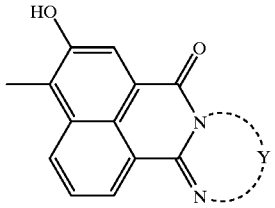

(6)

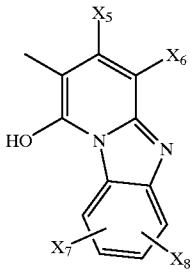

(7)

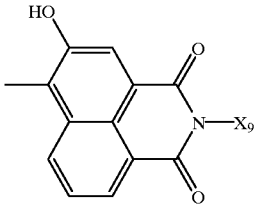

where $X_1$ represents a hydrogen atom or CONHR (R represents a hydrogen atom, an alkyl group, which is allowed to have a substituent, an aryl group, or a heterocyclic group); Z represents a remained group which is condensed with a benzene ring so as to form an aromatic ring or an aromatic heterocycle; $X_2$ and $X_5$ independently represent an alkyl group, which is allowed to have a substituent, an allyl group, or a heterocyclic group; $X_3$ and $X_6$ independently represent a hydrogen atom, a cyano group, a carbamoyl group, a carboxyl group, ester group, or an acyl group; $X_4$ and $X_9$ independently represent a hydrogen atom, an alkyl group, which is allowed to have a substituent, a cycloalkyl group, an alkenyl group, an aralkyl group, an aryl group, or a heterocyclic group; $X_7$ and $X_8$ independently represent a hydrogen atom, a halogen group, a nitro group, an alkyl group, which is allowed to have a substituent, and an alkoxy group; and Y represents a remained group forming an aromatic hetrocycle.

14. A manufacturing method for an electrophotographic element, which contains X-type metal-free phthalocyanine and a disazo compound as a charge generating substance, comprising the step of preparing a coating for a charge generating layer or a photosensitive layer that contains said disazo compound and said X-type metal-free phthalocyanine, wherein a solvent, which contains at least one selected from a group consisting of methyl ethyl ketone, cyclohexanone, and tetrahydrofuran, is adopted as a solvent for dispersing said charge generating substance that is contained in said coating, said disazo compound being represented by following general formula (1), (1)

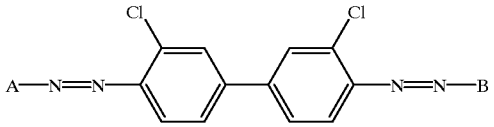

where A and B respectively correspond to any one of coupler remained groups represented by following general formulas (2)–(7), and A and B can also serve as coupler remained groups having the same construction, (2)

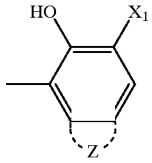

(3)

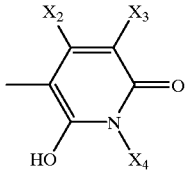

(4)

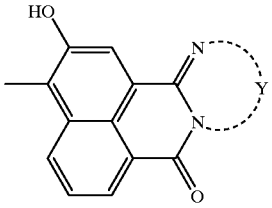

-continued (5)

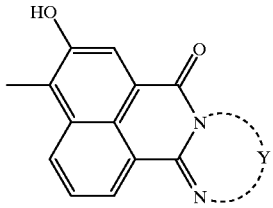

(6)

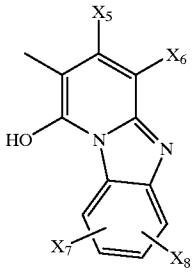

(7)

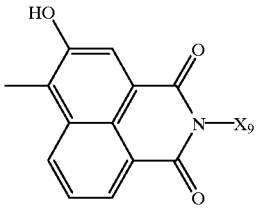

where $X_1$ represents a hydrogen atom or CONHR (R represents a hydrogen atom, an alkyl group, which is allowed to have a substituent, an aryl group, or a heterocyclic group); Z represents a remained group which is condensed with a benzene ring so as to form an aromatic ring or an aromatic heterocycle; $X_2$ and $X_5$ independently represent an alkyl group, which is allowed to have a substituent, an allyl group, or a heterocyclic group; $X_3$ and $X_6$ independently represent a hydrogen atom, a cyano group, a carbamoyl group, a carboxyl group, ester group, or an acyl group; $X_4$ and $X_9$ independently represent a hydrogen atom, an alkyl group, which is allowed to have a substituent, a cycloalkyl group, an alkenyl group, an aralkyl group, an aryl group, or a heterocyclic group; $X_7$ and $X_8$ independently represent a hydrogen atom, a halogen group, a nitro group, an alkyl group, which is allowed to have a substituent, and an alkoxy group; and Y represents a remained group forming an aromatic hetrocycle.

* * * * *